US005080571A

United States Patent [19]

Crawford

[11] Patent Number: 5,080,571

[45] Date of Patent: Jan. 14, 1992

[54] PACKERHEAD ASSEMBLY

[75] Inventor: Gerald R. Crawford, Ponca, Nebr.

[73] Assignee: International Pipe Machinery Corporation, Soiux City, Iowa

[21] Appl. No.: 486,629

[22] Filed: Feb. 28, 1990

[51] Int. Cl.[5] ..... B28B 21/26

[52] U.S. Cl. ..... 425/262; 264/312; 425/427

[58] Field of Search ..... 425/426, 427, 262; 264/312

[56] References Cited

U.S. PATENT DOCUMENTS

| | | | |
|---|---|---|---|
| 1,895,740 | 1/1933 | Ukropina | 425/262 |
| 2,751,657 | 6/1956 | Holston | 425/262 |
| 3,632,270 | 1/1972 | Baker et al. | 425/262 |
| 3,733,163 | 5/1973 | Hermann | 425/262 |
| 3,746,494 | 7/1973 | Gauger | 425/262 |
| 4,340,553 | 7/1982 | Fosse | 425/262 |
| 4,540,539 | 9/1985 | Crawford et al. | 425/427 |

FOREIGN PATENT DOCUMENTS

| | | | |
|---|---|---|---|
| 2365254 | 7/1974 | Fed. Rep. of Germany | 425/427 |
| 2738944 | 3/1979 | Fed. Rep. of Germany | 425/427 |
| 3012090 | 10/1981 | Fed. Rep. of Germany | 425/262 |
| 383861 | 1/1965 | Switzerland | 425/427 |
| 990534 | 1/1983 | U.S.S.R. | 425/427 |
| 1315327 | 6/1987 | U.S.S.R. | 425/427 |

*Primary Examiner*—James C. Housel

*Attorney, Agent, or Firm*—Baker & McKenzie

[57] ABSTRACT

A packerhead assembly for use in making concrete pipes. The packerhead assembly includes a rollerplate with rollers mounted thereto, and a long segmented longbottom assembly comprised of two substantially identical troweling members, one of which is inverted with respect to the other. The two troweling members combine to form an elongated troweling surface which allows the use of concrete mixes having high fluidity. The longbottom assembly also utilizes removable wear bands which limit the ingress of concrete material to the interior of the longbottom assembly. The wear bands are of particular value when utilizing highly fluid concrete mixes.

4 Claims, 2 Drawing Sheets

PACKERHEAD ASSEMBLY

BACKGROUND AND SUMMARY OF THE INVENTION

The present invention relates to an apparatus for the production of concrete pipe. In particular, the invention is concerned with an improved packerhead assembly configuration, which is particularly useful in the manufacture of concrete pipes with which highly fluid concrete mixes are used.

Manufacturers of concrete pipe have for many years used machines which employ apparatus known as "packerheads" or "packerhead assemblies". In such machines, a large, inverted U-shaped main frame is used in connection with a drive-shaft to which the packerhead is connected. The packerhead assembly is lowered into a form, and the packerhead is placed at the bottom of the form. As concrete is placed around the inside periphery of the form, the packerhead is raised. Rotational movement of the components of the packerhead cause the concrete to be packed and smoothed as the packerhead is raised.

In U.S. Pat. No. 4,540,539, which is assigned to the assignee of this invention and which is incorporated herein by reference, the operation of a typical packerhead assembly is shown and described. In addition, U.S. Pat. No. 4,540,539 describes a bi-directional packerhead in which the roller assembly and the longbottom assembly are rotated in opposite directions. A typical packerhead assembly includes a longbottom and a roller assembly, the longbottom being the lowermost component of the packerhead assembly. In most cases, a very dry mix of concrete is used in connection with packerhead assemblies. However, in some cases, wetter concrete mixtures provide a higher strength concrete and a better bond between the concrete material and steel reinforcing framework around which the concrete is placed. Unfortunately, higher water content significantly increases the likelihood that concrete will flow or otherwise deform after the packerhead assembly has been raised above a particular level. Increasing demand for higher strength concrete pipe has made traditionally designed packerhead assemblies less effective. The consequences of using wetter concretes are particularly noticeable in the case of pipes having large wall thickness. There is a tendency for the concrete in thicker walls to flow downwardly and inwardly after a longbottom has been raised from its lowest position. Attempts have been made to increase the length of longbottoms. Longbottoms having axial lengths of 10 inches have been used in conjunction with roller assemblies with axial lengths of 10 inches. However, such arrangements are quite expensive in that they require the use of specially designed equipment and components.

Another difficulty encountered when using concrete mixes which have higher than normal fluidity or water content is the tendency for such mixes to infiltrate the packerhead assembly. Such infiltration of concrete material causes increased wear on moving components of the packerhead assembly, and results in splatter of the infiltrating concrete as it comes into contact with the rotating longbottom.

Therefore, it is an object of the present invention to provide a packerhead assembly which is designed for use with concrete mixes having relatively high fluidity.

Another object of the present invention is to provide a packerhead assembly in which standard roller assembly and longbottom assembly components can be used.

Yet another object of the present invention is to provide a packerhead assembly in which wear on rotating parts is reduced.

Yet another object of the present invention is to provide a specially designed longbottom assembly which is usable with relatively wet concrete.

Still another object of the present invention is to provide an apparatus particularly useful for making concrete pipes with thick walls.

These and other objects of the present invention are achieved with the packerhead assembly which includes a long-bottom assembly and a rollerhead assembly, such assemblies being rotatable in opposite directions. The longbottom assembly is comprised of a longbottom support plate and a long-bottom cylinder. The longbottom cylinder extends a substantial distance below the longbottom plate, and is preferably comprised of two 6-inch segments. The segments are those which are typically used with a standard packerhead assembly. However, the lower of the two longbottom segments is inverted, and mounted adjacent to an upper identical segment. The longbottom segments are mounted to a mounting flange, which is integral with the longbottom plate. The longbottom flange is equipped with a removable wear band attached to the upper surface of the mounting flange to limit the ingress of concrete material to the area around the rollerhead assembly. The wear band extends upwardly from the uppermost level of the long-bottom to a position approximately ⅛-inch from the lowermost portion of the rollers of the roller assembly.

DETAILED DESCRIPTION OF THE INVENTION

Figure 1:
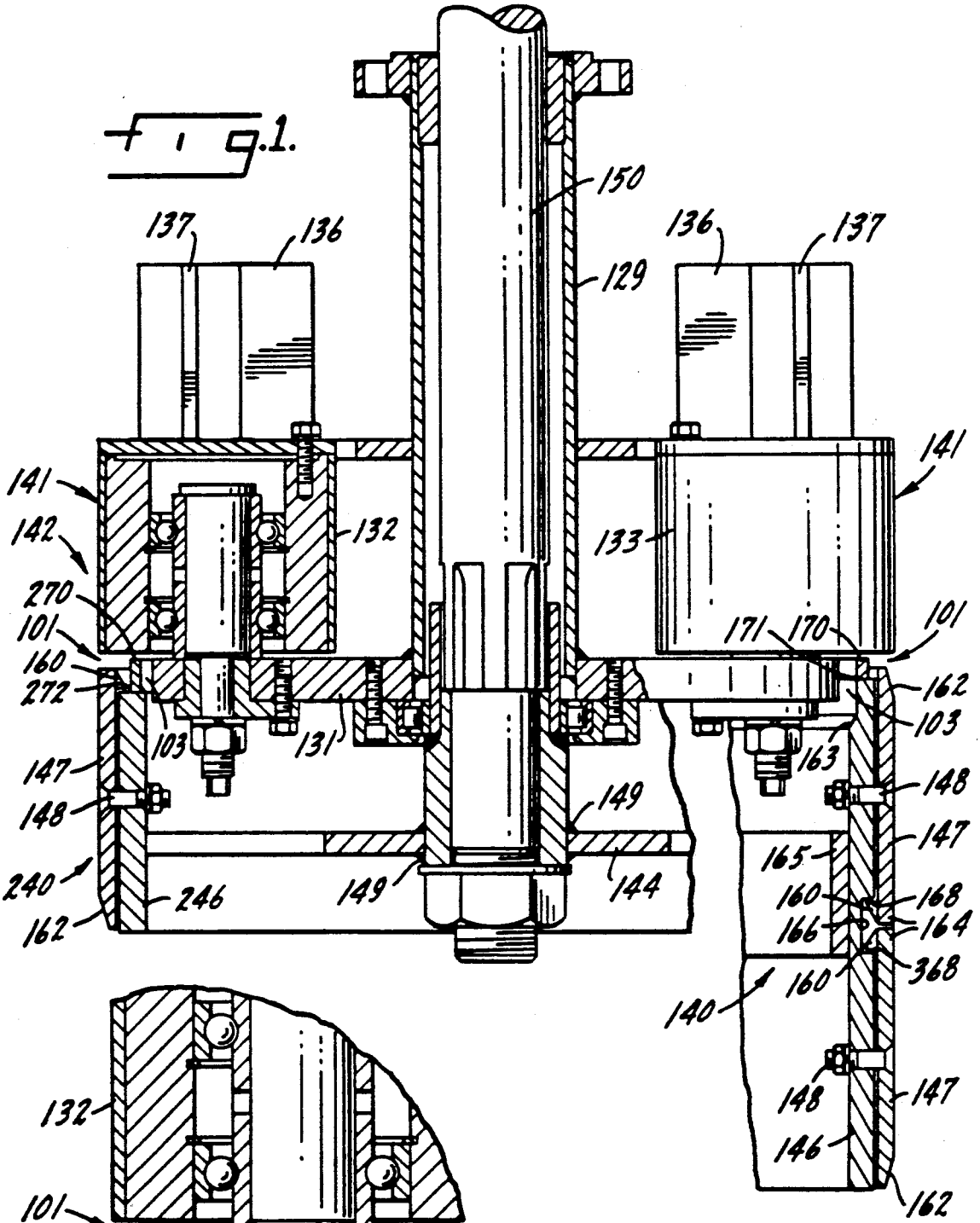
FIG. 1 is a split sectional view showing a standard longbottom in conjunction with a wearplate of the present invention, and an improved longbottom assembly of the present invention.

FIG. 1 is a sectional view of a packerhead assembly 142, the right side of which shows one embodiment, and the left side of which shows another embodiment. Both embodiments utilize a rollerhead assembly 141, a longbottom drive-shaft 150, and a rollerhead drive-shaft 129. A circular bottom plate 144 is welded at 149 to a lower end of the longbottom drive-shaft 150. Similarly, a roller mounting plate 131 is rigidly connected by welds to a lower end of the rollerhead drive-shaft 129. Rollers 132 and 133 are mounted to the roller mounting plate 131. Each of the rollers has blades 136 and 137, which assist in the radially outward and downward movement of concrete. The roller mounting plate 131 and the circular bottom plate 144 are adapted to be rotated in opposite directions. Providing such counter-rotation results in the formation of a gap 101 between the rollerhead assembly 141 and the longbottom assembly 140 or 240.

The right side of FIG. 1 shows an improved longbottom assembly 140 which is comprised of an elongated longbottom mounting flange 146 and two substantially identical troweling members 147. The upper troweling member has a series of cleats 160 disposed around the lower inside periphery thereof. Similarly, the lower troweling member has a series of cleats 160 around the upper inner periphery thereof. The troweling edges 164. The cleats 160 are disposed in a slot 166 formed in a central portion of the outer surface of the mounting flange 146. The groove 166 forms upper and lower shoulders, 168 and 368 respectively, which engage the cleats 160. The cleat and shoulder engagement, together with the bolts 148, hold the troweling members tightly in position against the mounting flange 146. The top surface of the mounting flange has a wear band 170 tackwelded thereto. The tackwelds 17 allow for ready replacement of the wear band 170. The wear band 170 provides substantial limitation to the ingress of concrete material to prevent splattering of such material against the interior walls of a pipe being formed.

The longer length of the elongated mounting flange 146 requires the use of a thicker material to prevent distortion. As a result, the upper inside edge of the mounting flange 146 has a circumferential notch 163 to allow clearance between the flange and the roller plate 131.

Further reason for the use of thicker material for the mounting flange 146 is the fact that the central notch 166 formed on the outside surface of the flange significantly reduces the thickness of the flange at that elevation. To further compensate for the absence of material caused by the notch 166, a backing member 165 is welded to the inside surface of the mounting flange. The backing member 165 strengthens the mounting flange and compensates for the notch 166.

The left side of FIG. 1 shows an alternative longbottom assembly 240 with a single troweling member 147 mounted to a mounting flange 246. A wear band 270 is tackwelded to the upper surface of the mounting flange 246 at an inside upper edge of the mounting flange. A shoulder 272 is formed. As with the earlier described embodiment, the engagement between the shoulder 272 and the cleat 160, together with the bolt 148, hold the troweling member 147 in a fixed position relative to the mounting flange 246.

Figure 2:
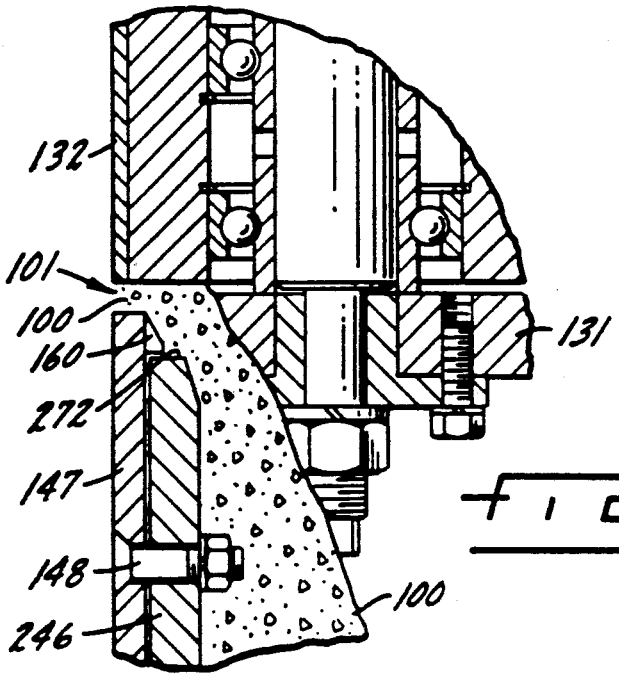
FIG. 2 is an enlarged sectional view of a packerhead assembly which does not employ the wear bands of the present invention.

FIG. 2 is an example of a longbottom assembly without a wear band. As shown in FIG. 2, concrete 100 can enter into the interior of the longbottom assembly. As the longbottom assembly is rotated, the concrete 100 will be flung against the inside surface of the concrete pipes being formed. In addition, the concrete 100, which flows radially inwardly between the roller 132 and the troweling member 147, can contribute significantly to contamination and excessive wear of the bearings which support the rollers. The wear bands 170 and 270 shown in FIG. 1 significantly reduce such contamination and wear. The wear bands 170 and 270 are disposed in such a way as to reduce the gap 101 between the rollers (132 and 133) and the uppermost edge of the wearbands. The gap 101 is preferably about ⅛-inch in axial length. The extent to which concrete will enter the interior of the longbottom assembly will depend upon the fluidity of the mix and the size of the aggregate used in the mix. Another important feature resulting from the removability of the wear bands 170 and 270 is the ability to select a wear band which will reduce the radial gap 103 between the wear band and the roller plate 131. By selecting a wear band of an appropriate diameter, the radial gap 103 can be selectively controlled to reduce the wear which results from counter rotation of the rollerhead and longbottom assemblies.

It is important to note that the troweling members 147, shown on the right and left hand sides of FIG. 1; are all substantially identical. The ability to use a troweling member of a single configuration with either mounting flange 146 or 246 simplifies the concrete pipe making operation. Since the troweling members are subject to wear and, therefore, require replacement, having an inventory of a single troweling member design is a distinct advantage.

Figure 3:
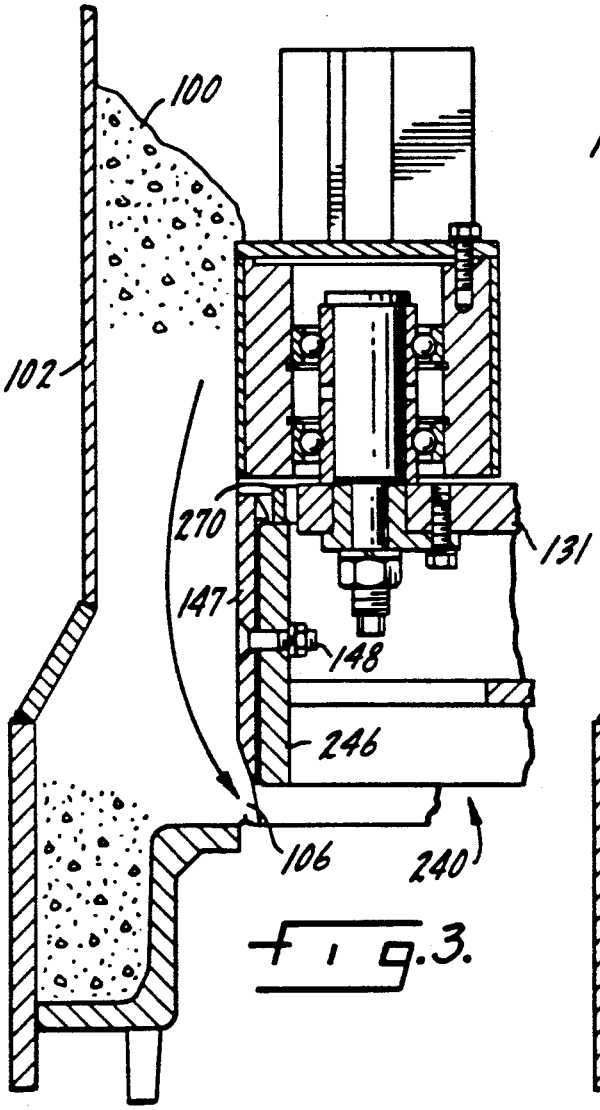
FIG. 3 is a sectional view showing a packerhead assembly at an initial stage in the formation of a concrete pipe.
Figure 4:
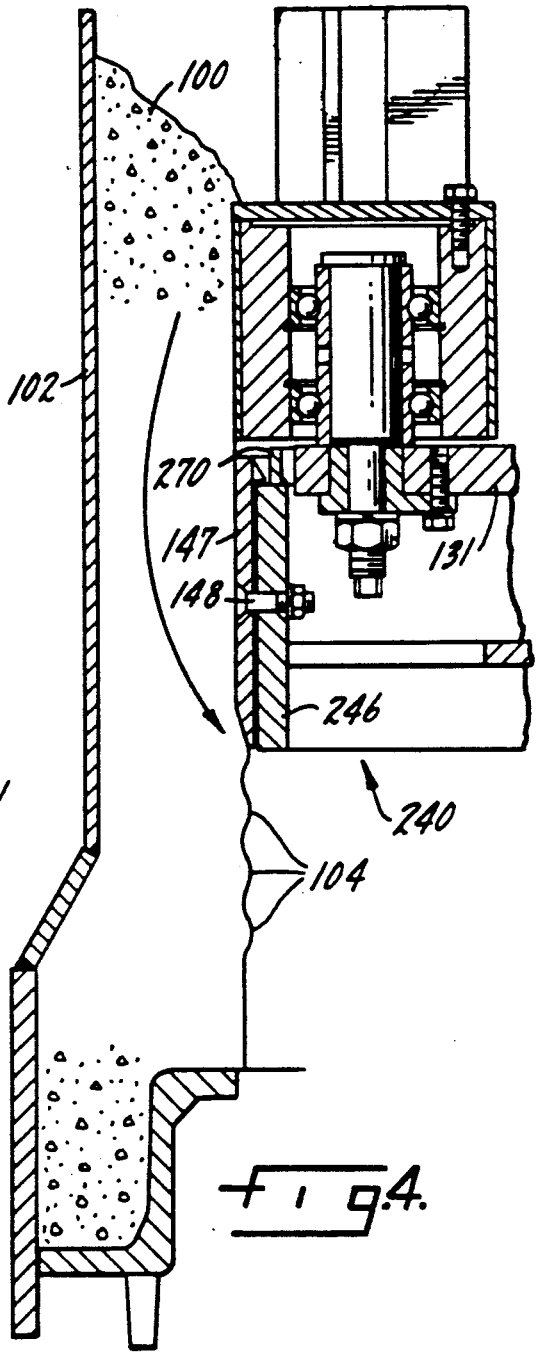
FIG. 4 is a sectional view showing a packerhead assembly at a subsequent stage in the making of a concrete pipe.

FIGS. 3 and 4 show the advantage of the extra length provided by a longbottom having two adjacent troweling members. When wet concrete 100 is placed between the form 102 and the longbottom assembly 240, the packing action of the rollers forces concrete downwardly. Such packing is required to completely fill the form 102 at the lower end thereof. However, such packing also tends to cause expansion of the pipe wall below the lower edge of the longbottom. Such reductions in the inside diameter of the pipe are highly undesirable. To alleviate this problem, elongated longbottoms are required. By utilizing a mounting flange such as the mounting flange 146 described above, two standard 6-inch high troweling members can be used together to create a longbottom having an overall length of about 12 inches. By using such a longbottom assembly, the bulging 106 (See FIG. 3) and the irregularities 104 (See FIG. 4) can be prevented.

The longbottom assembly of this invention provide two very important advantages having particular application in the manufacture of concrete pipes with which wet concrete mixes are used. First, it allows the use of two standard 6-inch troweling members to create an elongated 12-inch longbottom which is usable with wet concrete mixes of the type needed to make strong large diameter pipes It has been found that the 12-inch longbottom can be used effectively even though the traditional 1 to 1 ratio between the axial lengths of the longbottom and rollers is not used. With the 12-inch longbottom of the present invention, a standard 6-inch length roller may be used. The 2 to 1 ration of longbottom length to roller length has been found to be very effective Second, the removable wear bands form a barrier to the flow of wet concrete into the interior regions of the packerhead assembly. The removability of the wear bands allows easy replacement thereof when friction has caused excessive wear.

While a specific embodiment of the invention has been shown and described, it will be apparent to those skilled in the art that numerous alternatives, modifications, and variations of the embodiment shown can be made without departing from the spirit and scope of the appended claims.

I claim:

1. In a concrete pipe making machine including a packerhead assembly having a longbottom assembly with a longbottom support plate and a longbottom cylinder, a rollerhead assembly, and means for rotating said longbottom assembly and said rollerhead assembly in opposite directions, said longbottom cylinder comprising an inner mounting flange and at least one outer troweling member, said mounting flange and said troweling member being connected by fastening means, said rollerhead assembly including a rollerhead plate for carrying roller assemblies, said mounting flange having removable wear protection means for limiting ingress of material to areas adjacent to said rollerhead assemblies, said wear protector means comprising a wear band carried by and removably attached to an upper portion of said mounting flange, said wear band extending axially upwardly higher than said troweling member, said wear band being removably attached to a top surface of said mounting flange by discrete disengageable connecting means spaced along interior positions of said mounting flange.

2. A machine in accordance with claim 1 wherein:

said discrete disengageable connection means are spotwelds, and said wear band is disposed so as to leave an upwardly facing shoulder on said top surface.

3. A machine in accordance with claim 2 wherein:

said troweling member has a plurality of cleats which engage said shoulder.

4. A machine in accordance with claim 1 wherein:

said wear protection means comprises a band removeably attached to said mounting flange, said band extending circumferentially substantially continually around said mounting flange to within approximately ⅛-inch from said rollerhead assembly as measured in an axial direction, said wear band extending axially upwardly to an elevation approximately equal to an upper surface of said rollerhead plate.

* * * * *